US007811059B2

(12) United States Patent
Sagucio

(10) Patent No.: US 7,811,059 B2
(45) Date of Patent: Oct. 12, 2010

(54) VARIABLE ANGLE OSCILLATING FAN

(76) Inventor: Esteban Nacapuy Sagucio, P.O. Box 514 Kilauea, Kauai, HI (US) 96754

( * ) Notice: Subject to any disclaimer, the term of this patent is extended or adjusted under 35 U.S.C. 154(b) by 98 days.

(21) Appl. No.: 12/012,471

(22) Filed: Feb. 4, 2008

(65) Prior Publication Data

US 2008/0206053 A1 Aug. 28, 2008

Related U.S. Application Data

(60) Provisional application No. 60/903,045, filed on Feb. 23, 2007.

(51) Int. Cl.
*F04D 29/36* (2006.01)

(52) U.S. Cl. ..... 416/100; 416/108; 416/169 R; 416/170 R; 416/246; 74/44; 74/49; 74/55; 74/397; 74/530; 74/568 R; 74/571.1; 74/600

(58) Field of Classification Search ..... 416/98, 416/100, 108, 110, 169 R, 170 R, 246, 247 R; 74/25, 44, 49, 55, 395–397, 530, 568 R, 571.1, 74/600

See application file for complete search history.

(56) References Cited

U.S. PATENT DOCUMENTS

| | | | | |
|---|---|---|---|---|
| 1,005,429 | A * | 10/1911 | Hollander et al. | 416/100 |
| 1,638,027 | A * | 8/1927 | Galvin et al. | 74/600 |
| 1,847,048 | A * | 2/1932 | Orr et al. | 74/600 |
| 2,791,122 | A * | 5/1957 | Momberg | 74/25 |
| 3,147,639 | A * | 9/1964 | Braskamp | 74/600 |
| 3,977,260 | A | 8/1976 | Winyar et al. | |
| 5,217,417 | A | 6/1993 | Zhengang | |
| 5,931,056 | A | 8/1999 | Tsaur | |
| 6,468,036 | B1 | 10/2002 | Song et al. | |
| 7,052,239 | B1 | 5/2006 | Riske | |

* cited by examiner

*Primary Examiner*—Christopher Verdier

(57) ABSTRACT

An adjusting mechanism for desired angle of an oscillating electric fan is disclosed. The adjusting knob is conveniently located about the top rear portion of the fan motor, adjacent the clutch knob. Adjusting the oscillating angle may be made when the fan is at rest, when it is running and oscillating at the same time, or when it is running at a fixed direction. Adjusting is fast and simple, only one hand is needed and no tools and mechanical know-how is necessary.

5 Claims, 3 Drawing Sheets

FIG. 2
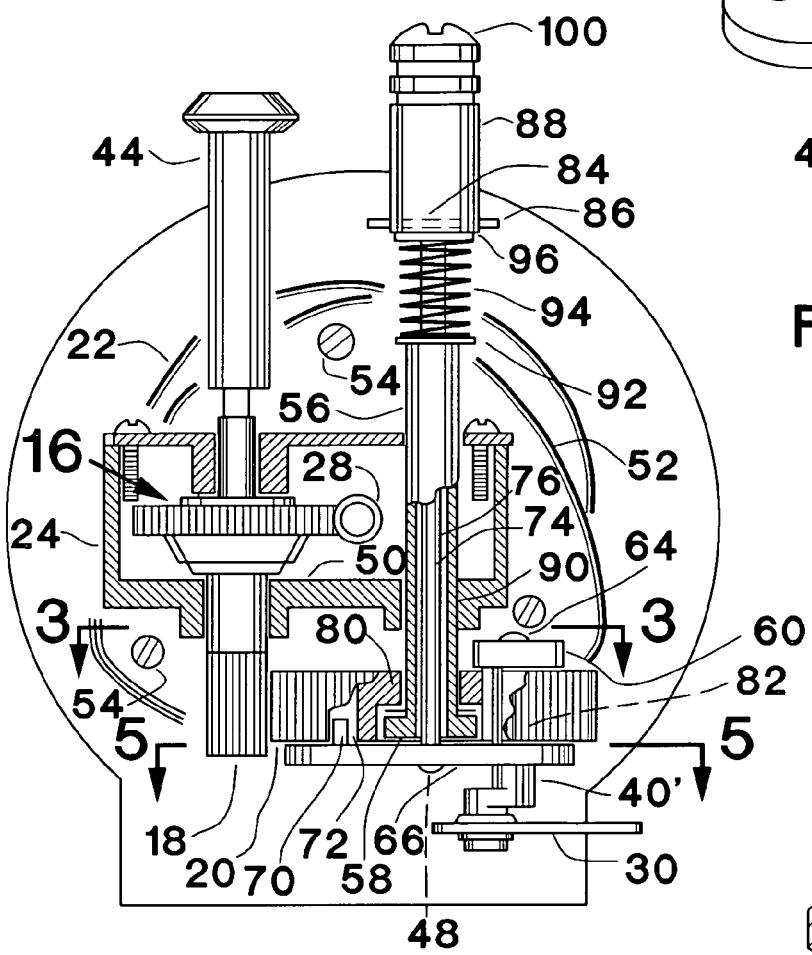
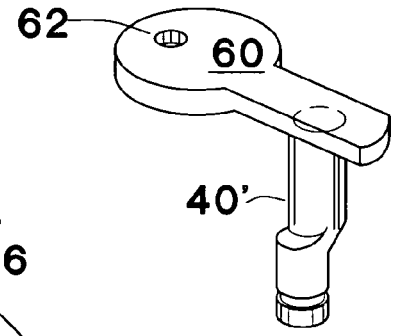
FIG. 7
FIG. 9
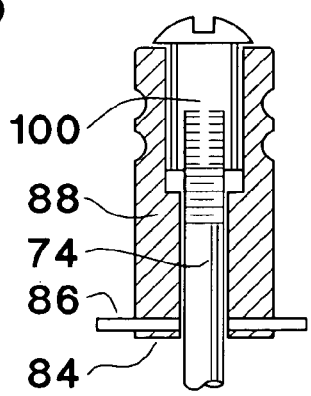

VARIABLE ANGLE OSCILLATING FAN

This application claims the benefit of Provisional Patent Application Ser. No. 60/903,045 filed Feb. 23, 2007 by the present inventor.

FIELD OF THE INVENTION

The present invention relates generally to cranks adapted for use in oscillating fans and more particularly to an improved mechanism for fast and simple adjusting for the desired oscillation angle of the fan.

RELATED PRIOR ART

Commonly used oscillating fans operate at a fixed angle of about 90-degrees range. These fans however, can be opted to operate for oscillating mode or for fixed-direction mode by simple manipulation of a clutch knob. Fans of the type mentioned above are found not very satisfactory to some users' requirements and needs.

Various schemes have been tried to oscillate the fan to desired oscillating angle in order to maximize utilization of the generated air stream. An example of this is U.S. Pat. No. 6,468,036 which proposed the use of eccentric disks to vary the crank length and hence the oscillating angle. U.S. Pat. No. 7,052,239B1 is pre-adjustable to a desired oscillation angle, and will adjust automatically to a lesser oscillation angle, or to "0" degrees if an interference by an object is encountered. These efforts do work well however, need for improvement is desired.

It is the object of the present invention to provide an improved oscillating fan.

Another object is to provide an oscillating angle adjusting knob which is very conspicuous and readily accessible.

Yet another object is to provide an adjusting mechanism operable with one hand and without tools.

Still another object is to provide an adjusting means wherein the oscillation angle may be adjusted even if the fan is running and oscillating at the same time, when the fan is at rest, or when it is running in a fixed direction.

More objects and advantages will become apparent from a consideration of the drawings and ensuing descriptions.

SUMMARY OF THE INVENTION

The present invention include new features and characteristics desirable for the user of the new oscillating fan. The oscillating angle adjusting knob is so conspicuous and accessible being located adjacent to the clutch knob on the rear top portion of the fan motor. The adjusting knob does not move in orbit and this makes it easy to manipulate even if the fan is running and oscillating at the same time. The adjusting knob simply rotate around an axis common with a hollow axle, adjusting rod, cam plate, and carrier disk.

THE DRAWINGS

FIG. 2 is a rear sectional view of an oscillating angle adjusting mechanism, taken generally along line 2-2 of FIG. 1.

FIG. 7 is a perspective of the offset-piece crank pin and swivel block assembly.

FIG. 9 is an enlarged sectional view of an adjusting knob for varying the oscillation angle of the fan.

DESCRIPTION OF THE INVENTION

Figure 1:
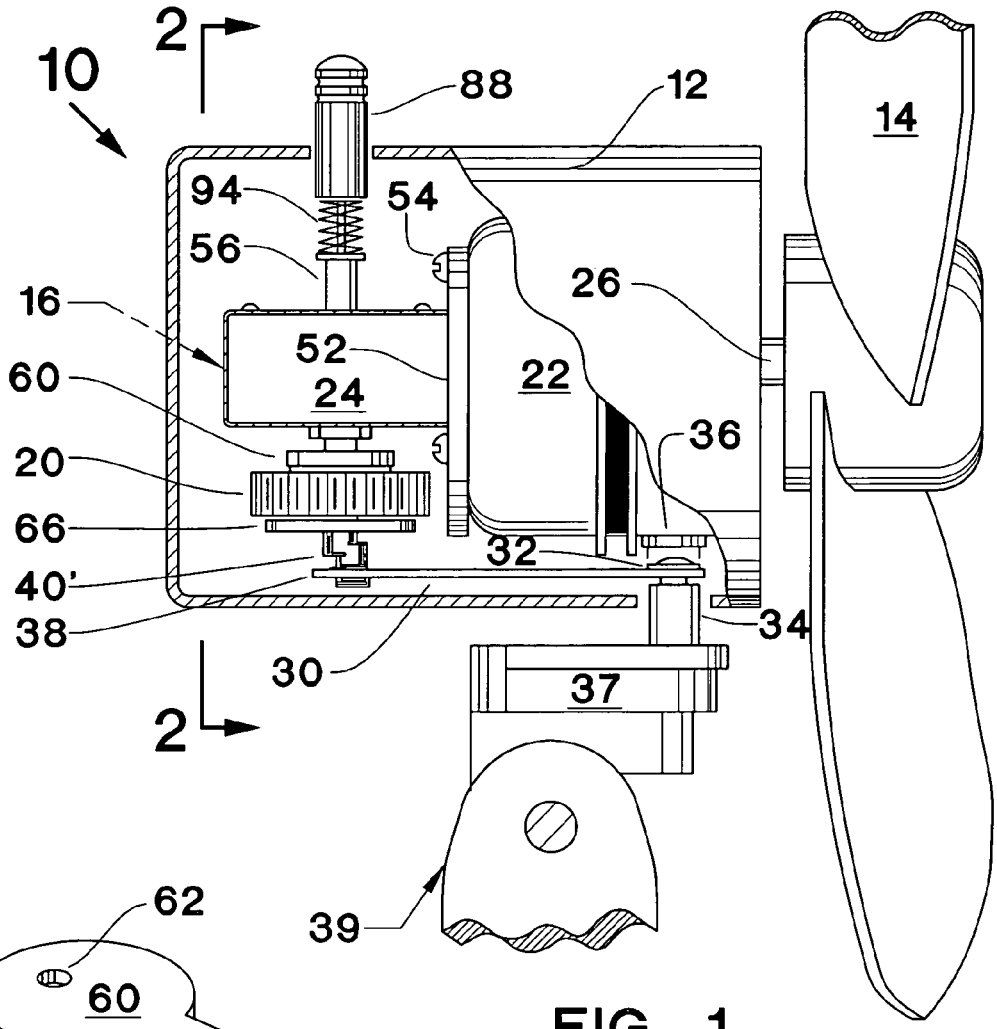
FIG. 1 is a side view of an oscillating electric fan with an adjusting knob located on the top rear portion of the motor assembly, and including a fan blade and an articutated upper and lower portions of the fan stand.

Referring to FIG. 1 an oscillating fan is constructed according to the teachings of the present invention. For simplicity some well known parts of the common fan has been omitted. The oscillating fan motor assembly is generally identified by reference numeral 10. The invention includes an electric motor 12, fan blade 14, clutch and worm gear unit 16 with toothed spindle 18 in mesh with a toothed carrier disk 20. Also shown is the fan motor rear housing 22 wherein the gear housing 24, enclosing the clutch and worm gear unit 16, is securely attached.

The motor shaft 26 rotates the fan blade 14 located on the front end, and a worm 28 integral with said shaft is located on the rear end. A swinging arm 30 is articulated with its first end 32 to a guide pin 34 adjacent to a support post 36 on the upper portion 37 of the fan stand 39, and its second end 38 is articulated with a crank pin 40'/40" (see FIGS. 7 and 8) on the carrier disk 20.

In FIG. 2, on the left side, the familiar oscillating clutch and worm gear unit 16 is shown and includes a clutch knob 44. Pushing down the knob will cause the running fan to engage and oscillate, while pulling up said knob will cause the clutch to disengage and the fan will operate in a steady direction. The worm 28 communicates with the toothed spindle 18 via the clutch and worm gear unit 16. The toothed spindle 18 mesh with the toothed carrier disk 20 which carries the crank pin at an orbit around a common axis 48.

The gear housing 24, which may be made of plastic, with reinforced bottom wall 50 and an expanded front wall 52 is mounted onto the rear end of the motor housing 22 with screws 54. The gear housing 24 encloses the clutch and worm gear unit 16 and also serves as a rigid support means for a hollow axle 56. The hollow axle includes a flange 58 on the lower end thereof.

Figure 8:
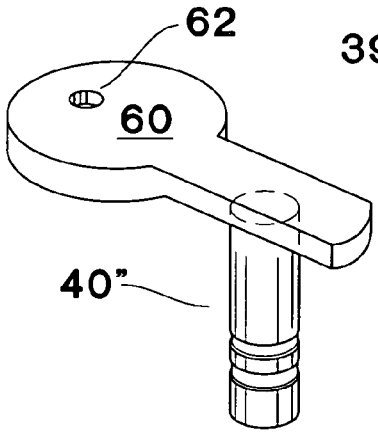
FIG. 8 is a perspective of the straight-piece crank pin and swivel block assembly.

An offset crank pin assembly is shown in FIG. 7. With said offset crank pin, shorter crankthrow is produced and hence a smaller oscillation angle of the fan. A "0" degree oscillation angle is also possible with a correct amount of larger offset of the crank pin. The crank pin may also be made a straight-piece as shown in FIG. 8. With the straight-piece type crank pin, the smallest oscillation angle produced will be larger than the smallest oscillation angle produced by an offset crank pin.

The crank pin, whether it is an offset-piece (FIG. 7) or a straight-piece (FIG. 8), in mounted perpendicularly underneath one end of a swivel block 60. On the free end of said swivel block is an opening 62 for a pin 64 to pivotally connect the block 60 to a strategic location on the upper side of the carrier disk 20.

Figure 3:
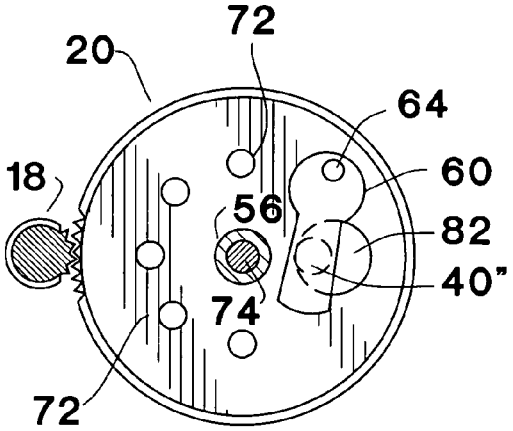
FIG. 3 shows a top view of a carrier disk supporting a straight-piece crank pin assembly (see FIG. 8), taken along line 3-3 of FIG. 2. The crank pin is shown swiveled closest to the center or common axis.
Figure 4:
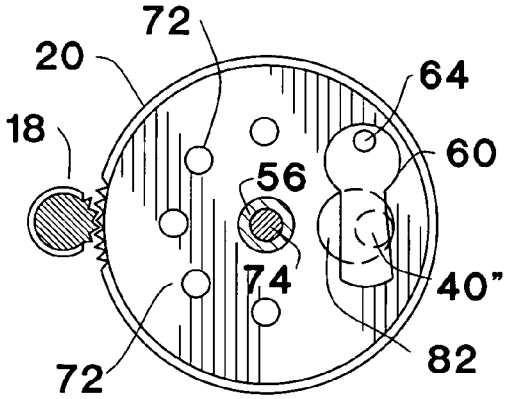
FIG. 4 is similar to FIG. 3 except that the straight-piece crank pin is swiveled furthest from the center or common axis.

A cam plate 66 (FIGS. 2, 5, and 6), for actuating the crank pin 40'/40", includes an arcuate through-opening 68 of desirable length and width, and having the ends generally opposing each other from the center or common axis 48. The ends of said arcuate through-opening are each distanced differently from the center or common axis, as shown. A detent pin 70 of about 3 mm. long is disposed on the upper side of the cam plate 66 a convenient distance from the common axis, and generally across from the arcuate opening, shown in FIGS. 5 and 6. Normally the detent pin 70 is "anchored" or received in any one of a plurality of detent holes 72 (see FIGS. 3 and 4).

Figure 5:
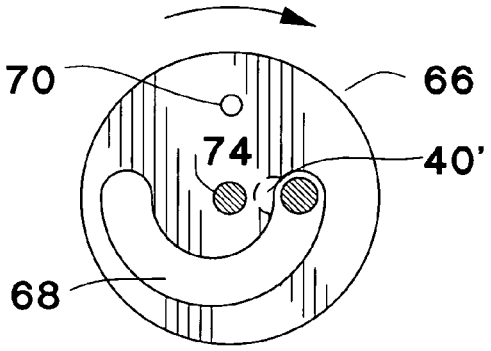
FIG. 5 shows a top view of a cam plate, taken generally along line 5-5 of FIG. 2, rotated fully clockwise. The crank pin shown here is an offset-piece crank pin (see also FIGS. 2 and 7), actuated closest to the common axis.

In FIG. 5, the cam plate 66 is shown turned fully clockwise and thus has actuated the crank pin 40' closest to the center for smallest oscillation angle of the fan.

Figure 6:
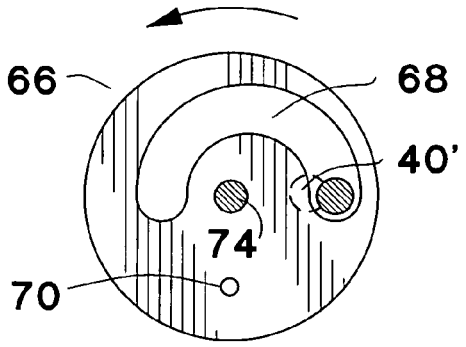
FIG. 6 is similar to FIG. 5 except that the cam plate is rotated fully counterclockwise and has actuated the offset-piece crank pin furthest from the axis.

Oppositely, in FIG. 6, the cam plate is turned fully counter-clockwise and thus has actuated the crank pin furthest from the center for largest oscillation angle of the fan. The arcuate opening 68 is slightly wider than the diameter of the crank pin 40' to permit rotation of the cam plate 66 when adjusting for a desired oscillation angle of the fan. The cam plate is rigidly attached with an adjusting rod 74 dimensioned to have free movement within the hollow 76 of hollow axle 56 when the adjusting rod is manipulated.

The toothed carrier disk 20 (FIG. 2) is shown in mesh with the toothed spindle 18. The carrier disk include a step bore 80 in the center, and an easement opening 82 (FIGS. 3 and 4) sized such that the crank pin upper portion can swivel with ease closer to or further from the axis 48 when adjusting the crank pin.

Plurality of detent holes 72 are disposed on the carrier disk 20 and sized to readily accommodate the detent pin 70. These detent holes 72 are at intervals and each one having same distance to the common axis, and which distance, is also same distance between the common axis and the detent pin. The five detent holes represent five different selections of oscillation angles in 10-degree increments, like for example, from the smallest oscillation angle of 50-degrees up to the largest oscillation angle of 90-degrees.

In FIG. 9 the adjusting knob 88 is shown enlarged. It includes a diametrical slot 84 on the bottom end thereof for accommodating a crosspin 86 disposed through an opening in the adjusting rod 74. The crosspin supports the adjusting knob 88 and also keep same from turning relative to the rod.

The assembled mechanism is best understood in FIG. 2. On the left side is the familiar design of clutch and gear unit 16 which include the toothed spindle, and therefore, further discussion is deemed not necessary. On the right side however, is a unique, fast and convenient approach to change to a new oscillation angle. The hollow axle 56 is secured tight fit through an opening 90 on the reinforced bottom wall 50 of the gear housing 24. The rotating carrier disk 20 is supported by the flanged bottom end of the hollow axle 56 as shown. On the top end of the hollow axle is a washer 92 upon which a rated compression spring 94 is seated. A second washer 96 is disposed between the upper end of the spring and the bottom end of the adjusting knob 88. The adjusting knob is secured with a barrel nut 100 onto the top end of the adjusting rod.

The cam plate 66 with the adjusting rod 74, and the knob 88 are all floated by the compression spring 94. The spring is so rated such that when the mechanism is assembled as shown in FIG. 2, the detent pin 70 locks-in with a selected detent hole 72, and the upper surface of the cam plate 66 slightly make contact with the lower surface of the carrier disk 20. Thereby, friction is minimal and thus energy loss is negligible.

OPERATION

With the new invention the fan may be operated between oscillating mode or non-oscillating mode. The oscillating angle may be changed when the fan is at rest, when it is running and oscillating at the same time, or when it is running in a steady direction. It is suggested however, for a beginner-operator, to disengage the clutch before adjusting for a new oscillation angle. This helpful tip may be later disregarded after several occasions of successful practice.

To change to a new oscillation angle, say from 70-degrees oscillation angle for example, is to first disengage the clutch, preferably when the fan is facing directly in front, by pulling up the clutch knob 44. Next, press down the adjusting knob 88 until the detent pin 70 has cleared off the detent hole 72 or until the lower side of the cam plate 66 abuts the shoulder of the crank pin, in the case of an offset-piece crank pin, shown in FIG. 2. With the adjusting knob 88 still depressed, turn said knob clockwise for selection to any of 2 smaller oscillation angles, in the order of 60-degrees and 50-degrees. Oppositely, turning the adjusting knob counter-clockwise (from 70-degrees, for example) will give a selection to any of the 2 larger oscillation angles, in the order of 80-degrees and 90-degrees.

When locating for a new detent hole with the detent pin 70, is to start turning, to a desired direction, the already-depressed adjusting knob 88 just a few degrees after the detent pin 70 has cleared the previous detent hole. Slightly ease the (depressed) pressure on the knob and continue on turning until the "feel" or a desired new detent hole is detected. After the new detent hole is located, release the adjusting knob to lock-in or "anchor" the detent pin. Press down the clutch knob to engage and oscillate the fan.

The embodiment having been described, changes in shape and form may be incorporated by those skilled in the art and such may be within the spirit and scope of the invention as defined by the claim herein appended.

What I claim:

1. Mechanism for varying an oscillating angle of an electric fan comprising:

(a) a worm integral with a rear end of a fan motor shaft for translating rotation to a toothed spindle of a clutch and worm gear unit, said toothed spindle meshing with a carrier disk;

(b) a gear housing means mounted onto a motor rear housing, and enclosing said clutch and worm gear unit, said gear housing means adapted for mounting a flanged hollow axle member;

(c) said hollow axle member having a vertical axis thereof, said axis being common with a cam plate member and said carrier disk;

(d) said carrier disk having an easement opening of size through which a crank pin is nested for horizontal swivel, and including plurality of detent holes into which a detent pin may be selectively received;

(e) a crank pin and swivel block assembly, with a first end of a swivel block portion thereof rigidly attached with said crank pin, and a second end of said swivel block is strategically connected to an upper side of said carrier disk for horizontal swivel of said crank pin and swivel block assembly toward or away from said vertical axis;

(f) said cam plate member disposed with an adjusting rod having an adjusting knob secured to the upper end of said adjusting rod, for actuation of said crank pin towards or away from said vertical axis; said cam plate further disposed with an arcuate through-opening dimensioned to movably accommodate said crank pin, and including said detent pin on the upper side thereof for locking-in any one of said plurality of detent holes on said carrier disk;

(g) a rated spring means interposed said adjusting knob and the upper end of said hollow axle for detachably biasing said carrier disk and said cam plate member toward each other and thus keeping a normally locked-in relationship between said detent pin and any of said plurality of detent holes;

(h) a swing arm having a first end articulated with a guide pin disposed at an upper portion of a fan stand, and a second end articulated with a crank pin disposed on the carrier disk;

(i) said carrier disk mounted for rotation about the bottom end of said flanged hollow axle member.

2. The combination of claim 1 wherein said adjusting rod is operatively disposed within the hollow of said hollow axle.

3. The combination of claim 2 wherein the crank pin is an offset-piece in structure.

4. The combination of claim 2 wherein the crank pin is a straight-piece in structure.

5. The combination of claim 3 wherein the offsetted lower portion of the crank pin is extended such that its axis is capable of aligning with said vertical axis in order to obtain a "0" degree oscillation angle.

* * * * *